US005533261A

United States Patent [19]

Kemmerer

[11] Patent Number: 5,533,261

[45] Date of Patent: Jul. 9, 1996

[54] METHOD FOR PRODUCING A VEHICLE WHEEL

[75] Inventor: James H. Kemmerer, Sweet Springs, Mo.

[73] Assignee: Hayes Wheels International, Inc., Romulus, Mich.

[21] Appl. No.: 368,167

[22] Filed: Dec. 30, 1994

[51] Int. Cl.[6] ..... B23P 19/00

[52] U.S. Cl. ..... 29/894.322; 29/894.354; 72/91

[58] Field of Search ..... 29/894.32, 894.321, 29/894.322, 894.323, 894.324, 894.325, 894.354, 894.351, 892.3; 301/63.1; 72/91

[56] References Cited

U.S. PATENT DOCUMENTS 3,601,450 8/1971 Baker et al. ..... 29/894.322

FOREIGN PATENT DOCUMENTS 1570620 6/1969 France ..... 301/63.1
1419140 12/1975 United Kingdom ..... 29/894.323

*Primary Examiner*—P. W. Echols
*Attorney, Agent, or Firm*—MacMillan, Sobanski & Todd

[57] ABSTRACT

An improved method for forming a vehicle wheel wherein the inboard and outboard tire bead seat retaining flanges are precisely oriented and located relative to an inboard mounting surface of the disc, and the inboard and outboard tire bead seat surfaces are precisely oriented and located relative to a wheel axis includes the steps of steps of: (a) providing a rim defining a rim axis and including at least an inboard portion and an outboard portion; (b) providing a disc defining a disc axis and including at least an inner annular wheel mounting portion and an outer annular portion, the wheel mounting portion defining an inboard mounting surface and having a centrally located pilot hole formed therethrough; (c) positioning the rim and disc together in generally coaxial relationship; (d) simultaneously with step (c), joining the outer annular portion of the disc to the rim by welding to produce a partially-formed wheel assembly defining a wheel axis; (e) subsequent to step (d), forming an inboard tire bead seat retaining flange, an outboard tire bead seat retaining flange, an inboard tire bead seat, and an outboard tire bead seat of the wheel to locate the inboard and outboard tire bead seat retaining flanges a predetermined first and second lateral distances, respectively, relative to the inboard mounting surface of the disc and in a parallel relationship therewith, and to locate the inboard and outboard tire bead seats a predetermined first and second radial distances, respectively, relative to the wheel axis and in a concentric relationship with the wheel axis.

6 Claims, 4 Drawing Sheets

METHOD FOR PRODUCING A VEHICLE WHEEL

BACKGROUND OF THE INVENTION

This invention relates in general to vehicle wheels and in particular to an improved method for forming a vehicle wheel.

A conventional vehicle wheel is typically of a two-piece construction and includes an inner disc and an outer "full" rim. The disc can be cast, forged, or fabricated from steel, aluminum, or other alloys, and includes an inner annular wheel mounting portion and an outer annular portion. The wheel mounting portion defines an inboard mounting surface and includes a center pilot or hub hole, and a plurality of lug receiving holes formed therethrough for mounting the wheel to an axle of the vehicle. The rim is fabricated from steel, aluminum, or other alloys, and includes an inboard tire bead seat retaining flange, an inboard fire bead seat, an axially extending well, an outboard tire bead seat, and an outboard tire bead seat retaining flange. In some instances, a three-piece wheel construction having a mounting cup secured to the disc is used. In both types of constructions, the outer annular portion of the disc is secured to the rim by welding.

A full face wheel is distinguished from other types of wheels by having a one-piece wheel disc construction. In particular, the full face wheel includes a "full face" disc and a "partial" rim. The full face disc can be formed cast, forged, or fabricated from steel, aluminum, or other alloys. The full face disc includes an inner annular wheel mounting portion and an outer annular portion which defines at least a portion of an outboard tire bead seat retaining flange of the wheel. The wheel mounting portion defines an inboard mounting surface and includes a center pilot or hub hole, and a plurality of lug receiving holes formed therethrough for mounting the wheel to an axle of the vehicle. The partial rim is fabricated from steel, aluminum, or other alloys, and includes an inboard tire bead seat retaining flange, an inboard tire bead seat, an axially extending well, and an outboard tire bead seat. In some instances, the outboard tire bead seat of the rim and the outer annular portion of the disc cooperate to form the outboard tire bead seat retaining flange of the full face wheel. In both types of constructions, the outboard tire bead seat of the rim is positioned adjacent the outer annular portion of the disc and a weld is applied to secure the rim and the disc together.

In the above wheel constructions, after the disc and rim are welded together several finishing operations are required to produce a wheel having the desired specifications. First, at least one of the inboard and outboard tire bead seats and/or at least one of the inboard and outboard tire bead seat retaining flanges must generally be machined so that the tire bead seats are located concentric with the wheel axis (commonly referred to as "radial runout") and the tire bead seat retaining flanges are oriented in a parallel relationship relative to an inboard mounting surface of the disc (commonly referred to as "axial runout"). Following this machining operation, the location of center pilot hole, the lug receiving holes, or both must usually be corrected by an appropriate method, such as reboring the center pilot hole and repunching the lug receiving holes, so that an axis of the center pilot hole is oriented in a concentric relationship relative to the wheel axis and the tire bead seats and the axes of the lug receiving holes are oriented parallel to the wheel axis.

SUMMARY OF THE INVENTION

The present invention relates to an improved method for forming a finished vehicle wheel-wherein the inboard and outboard tire bead seat retaining flanges are precisely oriented and located relative to an inboard mounting surface of the disc, and the inboard and outboard tire bead seat surfaces are precisely oriented and located relative to a wheel axis without requiring the above described finishing operations. In particular, the preferred method for producing the vehicle wheel includes the steps of: (a) providing a rim defining a rim axis and including at least an inboard portion and an outboard portion; (b) providing a disc defining a disc axis and including at least an inner annular wheel mounting portion and an outer annular portion, the wheel mounting portion defining an inboard mounting surface and having a centrally located pilot hole formed therethrough; (c) positioning the rim and disc together in generally coaxial relationship to produce a partially-formed wheel assembly defining a wheel axis; (d) simultaneously with step (c), joining the outer annular portion of the disc to the rim by welding to produce a partially-formed wheel assembly defining an axis; (e) subsequent to step (d), forming an inboard tire bead seat retaining flange, an outboard tire bead seat retaining flange, an inboard tire bead seat, and an outboard tire bead seat of the wheel to locate the inboard and outboard me bead seat retaining flanges at predetermined first and second lateral distances, respectively, relative to the inboard mounting surface of the disc and in a parallel relationship therewith, and to locate the inboard and outboard tire bead seats at predetermined first and second radial distances, respectively, relative to the wheel axis and in a concentric relationship therewith. Alternatively, during step (e), only one of the inboard and outboard tire bead seat retaining flanges can be formed, or only one of the inboard and outboard tire bead seat retaining flanges and one of the inboard and outboard tire bead seats can be formed, or both the inboard and outboard fire bead seat retaining flanges and only one of the inboard and outboard fire bead seats can be formed.

Forming the vehicle wheel according to the method of the present invention results in a finished wheel having tight specifications in the inboard and outboard tire bead seat areas and the inboard and outboard tire bead seat retaining flange areas without requiring the above described finishing operations.

Other advantages of this invention will become apparent to those skilled in the art from the following detailed description of the preferred embodiment, when read in light of the accompanying drawings.

DESCRIPTION OF THE PREFERRED EMBODIMENT

Figure 1:
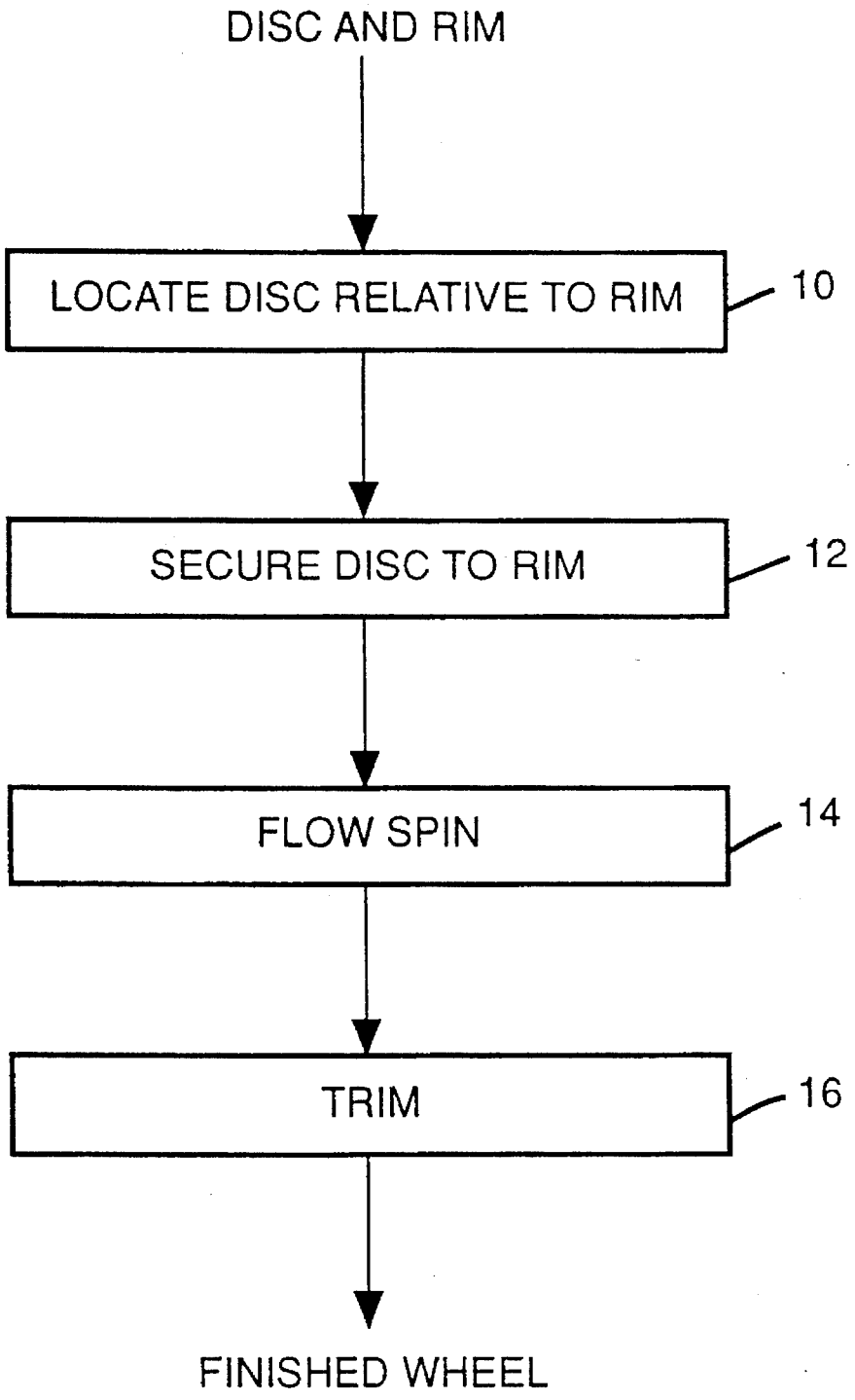
FIG. 1 is a block diagram showing a sequence of steps for producing a vehicle wheel in accordance with the present invention

Referring now to the drawings, there is illustrated in FIG. 1 a block diagram showing a sequence of steps for producing a vehicle wheel in accordance with the present invention. The vehicle wheel of the present invention can be a conventional "well attached" vehicle wheel, indicated generally at 20 in FIG. 3, or a "full face" vehicle wheel, indicated generally at 80 in FIG. 5A. Although the present invention is illustrated and described in conjunction with the particular vehicle wheel constructions disclosed herein, it will be appreciated that the invention can be used in conjunction with other types of vehicle wheel constructions. For example, the vehicle wheel can be a "bead seat attached wheel" (such as shown in FIG. 4 of U.S. Pat. No. 5,188,429 to Heck et al.), or a "modular wheel" construction including a partial rim and a full to face wheel disc (such as shown in U.S. Pat. No. 5,360,261 to Archibald et al.), all of these patents incorporated herein by reference.

Figure 3:
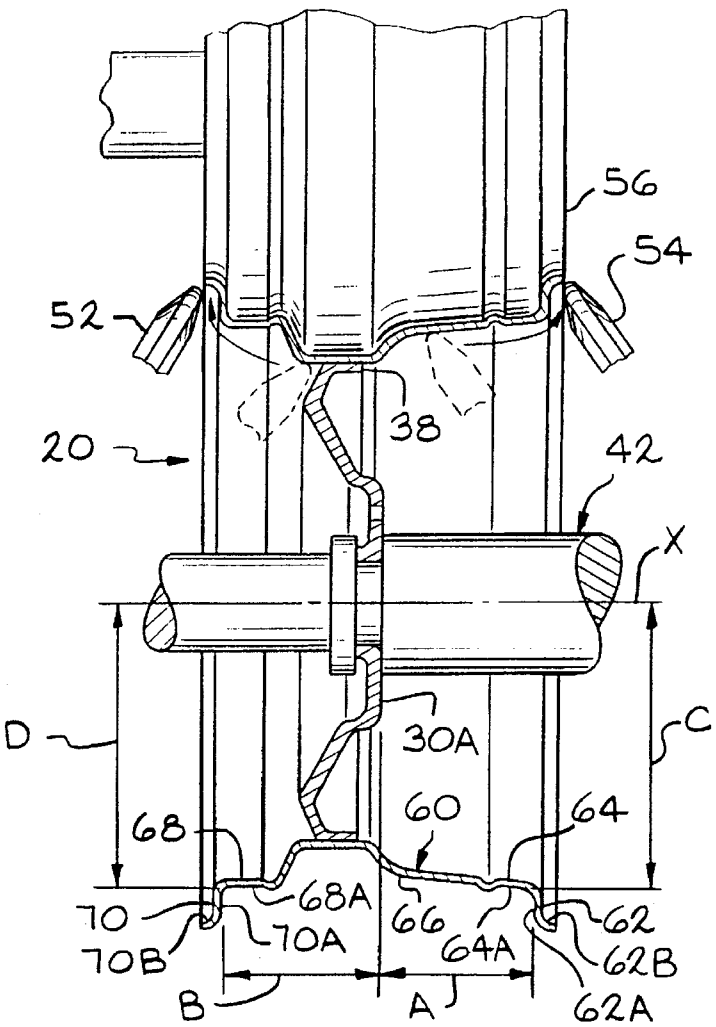
FIG. 3 is a partial sectional elevational view of a finished conventional vehicle wheel after the spinning operation.
Figure 2:
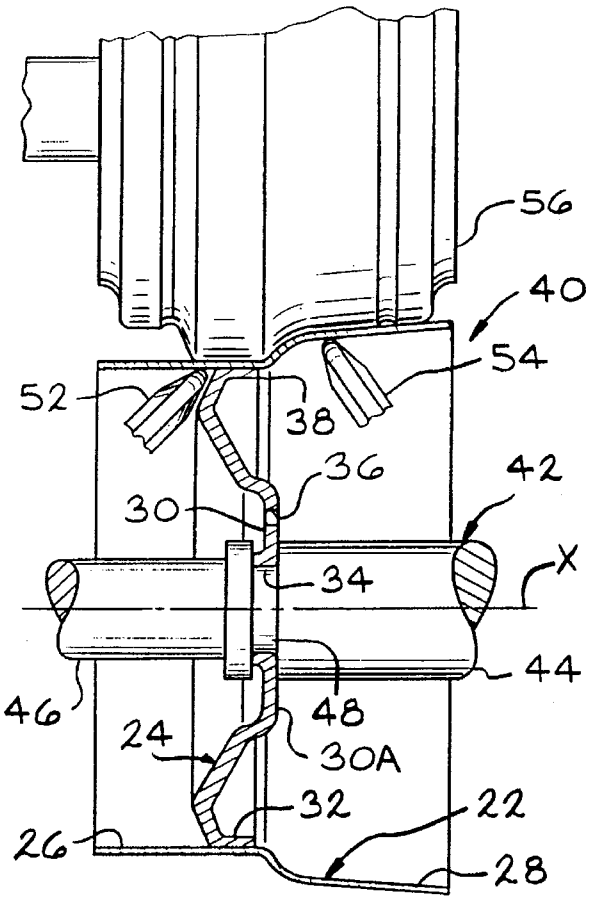
FIG. 2 is a partial sectional elevational view of a partially-formed rim secured to a partially-formed disc and prior to performing a spinning operation to produce a conventional vehicle wheel in accordance with the present invention.

Turning now to FIGS. 1–3, the method for producing the conventional vehicle wheel 20 of the present invention will be discussed. Initially, in step 10, a partially-formed rim 22 defining a rim axis, and a fully formed disc 24 defining a disc axis are located in a generally coaxial relationship. The rim 22 is a fabricated rim constructed of aluminum, steel, or other alloys, and includes an outboard portion 26 and an inboard portion 28.

The disc 24 is a forged, cast or fabricated disc constructed of aluminum, steel, or other alloys, and includes an inner annular wheel mounting portion 30 and an outer annular portion 32. The inner annular wheel mounting portion 30 defines an inboard mounting surface 30A, and includes a centrally located pilot hole 34, and a plurality of lug bolt receiving holes 36 formed therein (only one hole 36 being illustrated). The pilot hole 34 defines an axis which is coaxial with the axis of the disc 24, and the lug bolt receiving holes 36 are equally and circumferentially spaced in the disc 24 around the pilot hole 34 and are located a predetermined distance relative to an axis of the pilot hole 34 in a parallel relationship therewith. The lug bolt receiving holes 36 are adapted to receive lug bolts and nuts (not shown) for securing the vehicle wheel 20 on the axle (not shown) of a vehicle. The disc 24 may also include a plurality of decorative openings (not shown) formed therein. Simultaneously with 10, the rim 22 is joined to the outer annular portion 32 of the disc 24 by a weld 38 in step 12 to produce a partially-formed wheel assembly 40, shown in FIG. 2. The partially-formed wheel assembly 40 defines a wheel axis X which is coaxial with the axis of the rim 22, the axis of the disc 24, and the axis of the pilot hole 34.

As shown in FIGS. 2 and 3, the partially-formed wheel assembly 40 is then supported on a wheel support fixture 42, and subjected to a flow spinning process in step 14. The illustrated wheel support fixture 42 includes a first section 44 and a second section 46 having a centering pilot member 48. The second section 46 and the first section 44 are rotatably supported by appropriate means (not shown). The pilot member 48 is provided with a predetermined outer diameter which generally corresponds to the outer diameter of the pilot hole 34 formed in the disc 24 to create a friction fit therebetween. Thus, when the partially-formed wheel assembly 40 is supported on the wheel support fixture 42, relative movement between the wheel assembly 40 and the wheel support fixture 42 is restricted.

In the illustrated embodiment, once the partially-formed wheel assembly 40 is supported on the wheel support fixture 42, a pair of spinning tools 52 and 54 (partially shown) are actuated in order to simultaneously flow spin the outboard portion 26 and the inboard portion 28, respectively, of the rim 22 against a back-up roller 56 in step 14. The spinning tools 52 and 54 are mounted on separate support members (not shown) which allow each of the spinning tools 52 and 54 to generally travel parallel to the profile of an outer surface of the back-up roller 56. The outer surface of the back-up roller 56 is provided with a predetermined contour which, as will be described, is effective to impart a predetermined contour to the partially-formed rim 22 during the flow spinning process of step 14. Preferably, the back-up roller 56 is rotatably supported on a member (not shown), and is driven by a motor (not shown).

During the flow spinning process of step 14, the inner surface of the outboard portion 26 of the rim 22 is engaged by an end of the spinning tool 52 and the material of the rim 22 is pushed forward by the tool 52 throughout the entire length thereof into engagement with the adjacent outer surface of the back-up roller 56. As the spinning tool 52 is advanced in the direction of the arrow shown in FIG. 3, the material of the outboard portion 26 of the rim 22 is pushed forward by the spinning tool 52 against the back-up roller 56 thereby increasing both the axial and radial dimensions of the outboard portion 26 of the rim 22 to form a predetermined outboard rim portion profile which generally corresponds to the outer surface of adjacent portion of the back-up roller 56.

Preferably, at the same time, the spinning tool 54 is advanced in the direction of the arrow shown in FIG. 3 and an end of the spinning tool 54 engages the material of the inboard portion 28 of the rim 22 and the material is pushed forward by the spinning tool 54 against the back-up roller 56 thereby increasing both the axial and radial dimensions of the inboard portion 24 of the rim 22 to form a predetermined inboard rim portion profile which generally corresponds to the outer surface of the adjacent portion of the back-up roller 56. Alternatively, the spinning tools 52 and 54 may be advanced one at a time, and/or a separate back-up roller for forming a desired finished inboard rim portion profile and a desired finished outboard rim portion profile may be used.

The flow spinning process of step 14 produces a finished wheel rim 60, and therefore, the finished fabricated wheel 20. In particular, the finished wheel rim 60 includes a tapered inboard tire bead seat retaining flange 62, a tapered inboard tire bead seat 64, a generally axially extending well 66, a tapered outboard tire bead seat 68, and a tapered outboard tire bead seat retaining flange 70.

By forming the inboard and outboard tire bead seats 64 and 68, respectively, and the inboard and outboard tire bead seat retaining flanges 62 and 70, respectively, after the disc 24 and the rim 22 have been secured together, the inboard and outboard tire bead seat retaining flanges 62 and 70, respectively, of the finished wheel 20 are precisely located relative to the disc 24, and the inboard and outboard tire bead seats 64 and 68, respectively, of the finished wheel 20 are precisely located relative to the wheel axis X. In particular, an inner surface 62A of the inboard tire bead seat retaining flange 62 of the finished wheel 20 is precisely located a lateral or axial distance A relative to the inboard mounting surface 30A of the disc 24 and in a parallel relationship therewith, and an inner surface 70A of the outboard tire bead seat retaining flange 70 is precisely located a lateral distance B relative to the inboard mounting surface 30A of the disc 24 and in a parallel relationship therewith.

Also, an outer surface 64A of the inboard tire bead seat 64 of the finished wheel 20 is precisely located a radial distance C relative to the wheel axis X and in a concentric relationship therewith, and an outer surface 68A of the outboard tire bead seat 68 is precisely located a radial distance D relative to the wheel axis X and in a concentric relationship therewith. Following step 14, an outer end portion 62B of the inboard tire bead seat retaining flange 62 and/or an outer end portion 70B of the outboard tire bead seat retaining flange 70 is slightly trimmed in step 16 to provide each end of the wheel 20 with a smooth side flange radius.

Turning now to FIGS. 1, 4, 4A, 5, and 5A, the method for producing the full face vehicle wheel 80 of the present invention will be discussed. Initially, in step 10, a partially-formed rim 82 defining a rim axis, and a partially-formed disc 84 defining a disc axis, are located in a generally coaxial relationship. As shown in FIG. 4, the partially-formed rim 82 is a fabricated rim constructed of aluminum, steel, or other alloys, and includes an outboard portion 86 and an inboard portion 88.

The disc 84 is a forged, cast or fabricated disc constructed of aluminum, steel, or other alloys, and includes an inner annular wheel mounting portion 90 and an outer annular portion 92. The inner annular wheel mounting portion 90 defines an inboard mounting surface 90A, and includes a centrally located pilot hole 94, and a plurality of lug bolt receiving holes 96 formed therein (only two lug receiving holes 96 being illustrated). The pilot hole 94 defines a pilot hole axis which is coaxial with the axis of the disc 24, and the lug bolt receiving holes 96 are equally and circumferentially spaced in the disc 84 around the pilot hole 94 and are located a predetermined distance relative to an axis of the pilot hole 94 in a parallel relationship therewith. The lug bolt receiving holes 96 are adapted to receive lug bolts and nuts (not shown) for securing the wheel 80 on the axle (not shown) of a vehicle. The disc 84 may also include a plurality of decorative openings (not shown) formed therein. Simultaneously with step 10, the rim 82 is joined to the outer annular portion 92 of the disc 84 by a weld 98 in step 12 to produce a partially-formed wheel assembly 100, shown in FIG. 4. The wheel assembly 100 defines a wheel axis X' which is coaxial with the axis of the rim, the axis of the disc, and the axis of the pilot hole.

Next, the partially-formed wheel assembly 100 is supported on a wheel support fixture 102, and subjected to a flow spinning process in step 14. The wheel support fixture 102 is illustrated as being a well known mandrel-tailstock assembly and includes a tailstock 104 and a spinning mandrel 106 having a centering pilot member 108. The mandrel 106 is rotatably mounted on a headstock (not shown) and is driven by a motor (not shown). The pilot member 108 is provided with a predetermined outer diameter which generally corresponds to the outer diameter of the pilot hole 94 formed in the disc 84 to create a friction fit therebetween. Thus, when the partially-formed wheel assembly 100 is supported on the wheel support fixture 102, relative movement between the wheel assembly 100 and the wheel support fixture 102 is restricted.

Figure 4A:
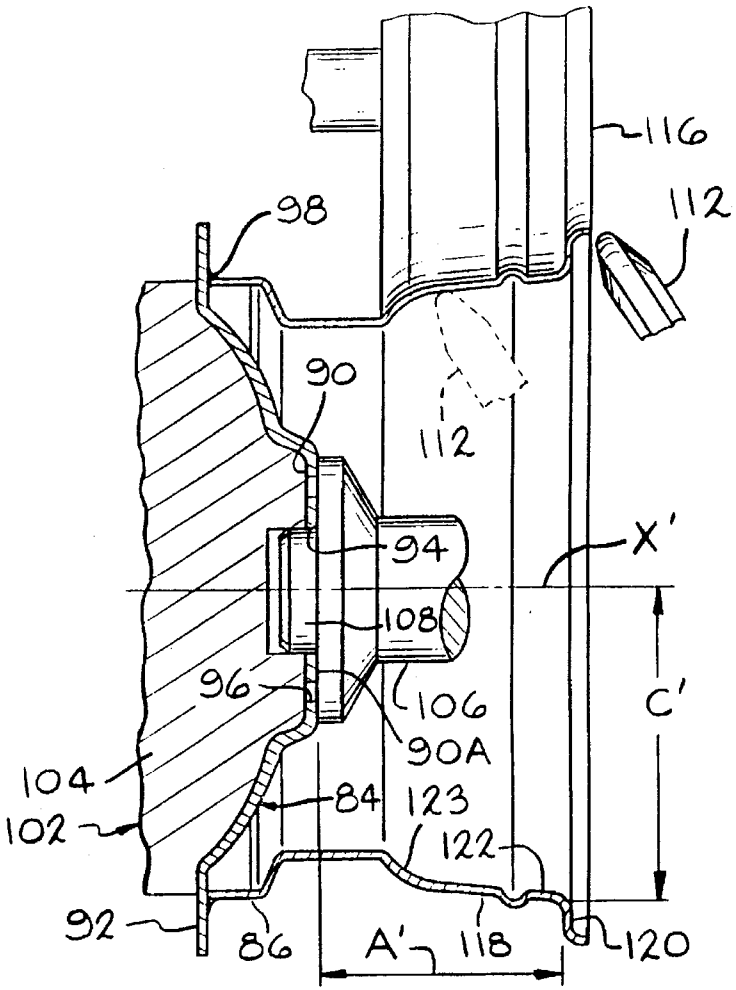
FIG. 4A is a partial sectional elevational view after the initial spinning process is completed.
Figure 4:
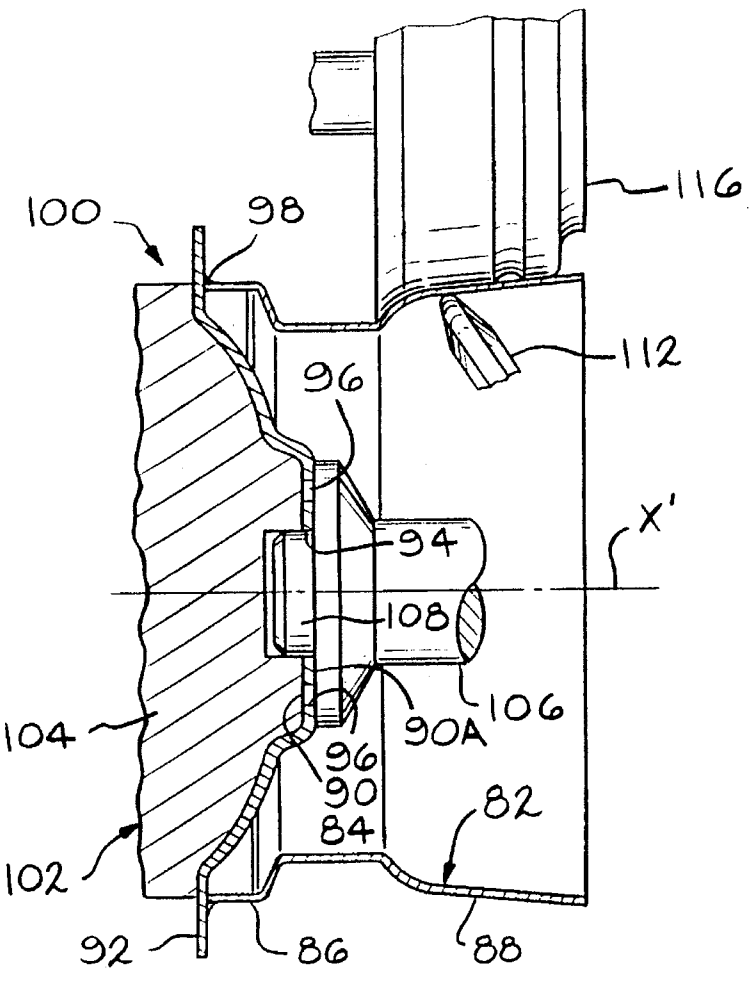
FIG. 4 is a partial sectional elevational view of a partially-formed rim secured to a partially-formed full face disc and prior to performing an initial spinning operation to produce a full face vehicle wheel in accordance with the present invention.

As shown in FIGS. 4 and 4A, once the partially-formed wheel assembly 100 is supported on the wheel support fixture 102, a spinning tool 112 is actuated in order to flow spin the inboard portion 88 of the partially-formed rim 82 against an outer surface of a back-up roller 116 in step 14. The spinning tool 112 is mounted on a support member (not shown) which allows the spinning tool 112 to generally travel parallel to the profile of an outer surface of the back-up roller 116, and the back-up roller 116 is rotatably supported on a member (not shown). As will be discussed, the outer surface of the back-up roller 116 is provided with a predetermined contour which is effective to impart a predetermined contour to the inboard portion 88 of the partially-formed rim 82 during the flow spinning process of step 14.

During the flow spinning process of step 14, the inner surface of the inboard portion 88 of the partially-formed rim 82 is engaged by an end of the spinning tool 112 and the material of the rim 82 is pushed forward by the tool 112 throughout the entire length thereof into engagement with the adjacent outer surface of the back-up roller 116. As the spinning tool 112 is advanced in the direction of the arrow shown in FIG. 4A, the material of the inboard portion of the partially-formed rim 82 is pushed forward by the spinning tool 112 against the back-up roller 116 thereby increasing both the axial and radial dimensions of the inboard portion 88 of the rim 82 to form a predetermined finished inboard rim portion 118 which generally corresponds to the outer surface of the adjacent portion of the back-up roller 116. In particular, the finished inboard rim portion 118 includes a tapered inboard tire bead seat retaining flange 120, a tapered inboard tire bead seat 122, and a generally axially extending well 123.

Figure 5A:
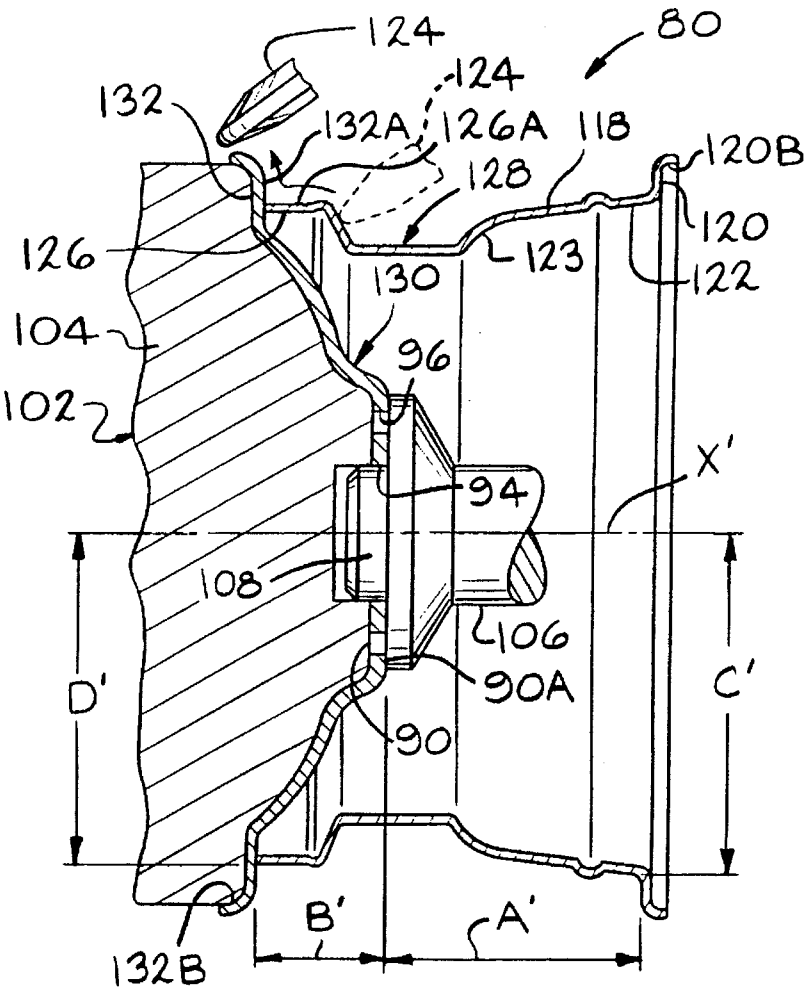
FIG. 5A is a partial sectional elevational view after the final spinning process is completed.
Figure 5:
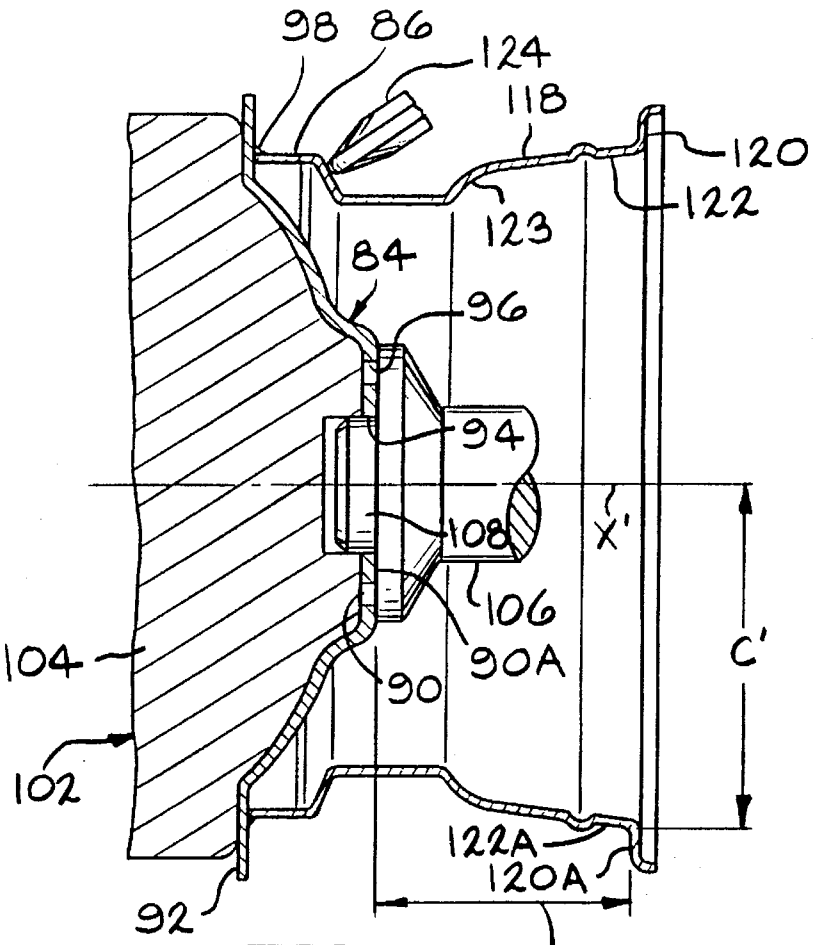
FIG. 5 is a partial sectional elevational view of the partially-formed full face wheel prior to performing a final spinning process.

Next, as shown in FIGS. 5 and 5A, the outboard portion 86 of the rim and the outer annular portion 92 of the partially-formed disc 84 are subjected to a flow spinning process which is also part of step 14. In particular, a spinning tool 124 is actuated to flow spin the outboard portion 86 of the rim and the outer annular wheel mounting portion 92 of the disc 84. The spinning tool 124 is mounted on a support member (not shown) which allows the spinning tools 124 The outer surface of the mandrel 104 is provided with a predetermined contour to generally follow parallel to the profile of the outer surface of the mandrel 104. The outer surface of the mandrel 104 is provided with a predetermined contour which, as will be described, is effective to impart a predetermined contour to the outer annular wheel mounting portion 92 of the partially-formed disc 84 during the flow spinning process of step 16.

During the flow spinning process of step 14, the outer surface of the outboard portion 86 of the rim, and then the inner surface of the outer annular wheel mounting portion 92 of the disc 84 are engaged by an end of the spinning tool 124 as the spinning tool 124 is advanced in the direction as shown in FIG. 5A. In particular, the end of the spinning tool 124 is operative to engage and reshape the material of the outboard portion 86 of the rim to form an outboard tire bead seat 126 and thereby produce a finished wheel rim 128.

Next, as the spinning tool 124 is further advanced in the direction of the arrow shown in FIG. 5A, the end of the spinning tool 124 engages the material of the outer annular wheel mounting portion 92 of the disc 84 and pushes the material forward against the mandrel 104 thereby increasing both the axial and radial dimensions of the outer annular wheel mounting portion 92 in the embodiment shown in FIG. 5A to form a finished full face wheel disc 130 having a profile which generally corresponds to the outer surface of the adjacent portion of the mandrel 104. In particular, the finished full face wheel disc 130 includes a tapered outer annular portion 132 which defines an outboard tire bead seat retaining flange of the full face wheel 80. Alternatively, the spinning tools 112 and 124 may be advanced at the same time to produce the finished full face wheel 80.

By forming the inboard and outboard tire bead seats 122 and 126, respectively, and the inboard and outboard tire bead seat retaining flanges 120 and 132, respectively, after the disc 84 and the rim 82 have been secured together, the inboard and outboard tire bead seat retaining flanges 120 and 132, respectively, of the finished full face wheel 80 are precisely located relative to the disc, and the inboard and outboard tire bead seats 122 and 126, respectively, of the finished full face wheel 80 are precisely located relative to the wheel axis X'. In particular, an inner surface 120A of the inboard tire bead seat retaining flange 120 of the finished wheel 80 is precisely located a lateral distance A' relative to the inboard mounting surface 90A of the disc 130 and in a parallel relationship therewith, and an inner surface 132A of the outboard tire bead seat retaining flange 132 of the finished wheel 80 is precisely located a lateral distance B' relative to the inboard surface 90A of the disc 130 and in a parallel relationship therewith.

Also, an outer surface 122A of the inboard tire bead seat 122 of the finished wheel 80 is precisely located a radial distance C' relative to the wheel axis X' and in a concentric relationship therewith, and an outer surface 126A of the outboard tire bead seat 126 of the finished wheel 80 is precisely located a radial distance D' relative to the wheel axis W' and in a concentric relationship therewith. Following step 14, an outer end portion 120B of the inboard tire bead seat retaining flange 120 and/or an outer end portion 132B of the outboard fire bead seat retaining flange 132 is slightly trimmed to provide each outer end of the wheel 80 with a smooth tire side flange radius.

One advantage of the method of the present invention is that since the rim and disc are secured together prior to forming the inboard and outboard fire bead seats and the inboard and outboard tire bead seat retaining flanges, the method of this invention eliminates the above described prior art finishing operations which are required to produce a wheel having desired specifications. In particular, the present invention locates the inboard and outboard tire bead seats in a concentric relationship relative to the wheel axis (i.e., the radial runout in the wheel) without requiting the above described prior art finishing operations. Also, the present invention locates the inboard and outboard tire bead seat retaining flanges in a parallel relationship relative to the inboard mounting surface of the inner annular portion of the disc (i.e., the lateral runout in the wheel) without requiring the above described prior art finishing operations.

Also, since the axis of the pilot hole is coaxial with the axis of the wheel when the wheel is supported in the wheel support fixture and during the forming of the inboard and outboard tire bead seats and the inboard and outboard tire bead seat retaining flanges, the axis of the pilot hole in the finished wheel is coaxial relative to the tire bead seats. In the prior art, as discussed above, since the rim was secured to the disc with the rim already including the inboard and outboard tire bead seats and the inboard and outboard tire bead seat retaining flanges, the location of the axis of the pilot usually had to be corrected to orient it in a concentric relationship relative to the inboard and outboard tire bead seats.

It will be appreciated that while the flow spinning process of step 14 has been illustrated and described as having the spinning tools 52 and 54 engage the tuner surface of the partially-formed rim 22 in the embodiment shown in FIGS. 2 and 3, one or both of the spinning tools can engage an outer surface of the partially-formed rim with the associated back-up roller being positioned adjacent the inner surface of the rim. Also, while the invention has been described and illustrated as tapering the inboard and outboard tire bead seat retaining flanges and the inboard and outboard tire bead seats during the flow spinning process of step 14, the inboard and outboard tire bead seat retaining flanges and/or the inboard and outboard tire bead seats may have a constant thickness to produce a finished rim having a generally constant thickness throughout its entire length.

In addition, only the inboard tire bead seat and/or the outboard tire bead seat can be tapered during the flow spinning process of step 14, and/or only the inboard tire bead seat retaining flange and/or the outboard tire bead seat retaining flange can be tapered during step 14. Furthermore, while the present invention has been illustrated and described as producing a full face wheel 80 using a partially-formed full face disc and a partially-formed partial rim, either the disc can be fully formed or the rim can be fully formed.

In accordance with the provisions of the patents statues, the principle and mode of operation of this invention have been described and illustrated in its preferred embodiment. However, it must be understood that the invention may be practiced otherwise than as specifically explained and illustrated without departing from the scope or spirit of the attached claims.

What is claimed is:

1. A method for forming a vehicle wheel comprising the steps of:

(a) providing a rim defining a rim axis and including at least an inboard portion and an outboard portion;

(b) providing a disc defining a disc axis and including at least an inner annular wheel mounting portion and an outer annular portion, the wheel mounting portion defining an inboard mounting surface and having a centrally located pilot hole formed therethrough;

(c) positioning the rim and disc together in generally coaxial relationship;

(d) simultaneously with step (c), joining the outer annular portion of the disc to the rim by welding to produce a partially-formed wheel assembly defining an axis;

(e) positioning a spinning tool of a flow spinning machine in contact with an inner surface of the partially-formed wheel assembly;

(f) operating the flow spinning machine whereby the spinning tool engages and forces the inner surface of the partially-formed wheel assembly against a back-up roller having a predetermined profile to form at least one of an inboard tire bead seat retaining flange and an outboard tire bead seat retaining flange of the wheel and to locate the at least one of the inboard tire bead seat retaining flange and the outboard tire bead seat retaining flange a predetermined lateral distance relative to the inboard mounting surface of the disc and in a parallel relationship therewith.

2. The method defined in claim 1 wherein step (f) further includes operating the flow spinning machine to form at least one of an inboard tire bead seat and an outboard tire bead seat of the wheel and to locate the at least one of the inboard tire bead seat and the outboard tire bead seat a predetermined radial distance relative to the wheel axis and in concentric relationship therewith.

3. The method defined in claim 1 wherein step (f) includes operating the flow spinning machine to form both the inboard tire bead seat retaining flange and the outboard tire bead seat retaining flange and to locate the inboard tire bead seat retaining flange a predetermined first lateral distance relative to the inboard mounting surface of the disc and in a parallel relationship therewith and to locate the outboard tire bead seat retaining flange a predetermined second lateral distance relative to the inboard mounting surface of the disc in a parallel relationship therewith, and operating the flow spinning machine to form at least one of an inboard tire bead seat and an outboard tire bead seat of the wheel and to locate the at least one of the inboard tire bead seat and the outboard tire bead seat a predetermined radial distance relative to the wheel axis and in a concentric relationship therewith.

4. The method defined in claim 1 wherein step (f) includes operating the flow spinning machine to form both the inboard tire bead seat retaining flange and the outboard tire bead seat retaining flange and to locate the inboard tire bead seat retaining flange a predetermined first lateral distance relative to the inboard mounting surface of the disc and in a parallel relationship therewith and to locate the outboard tire bead seat retaining flange a predetermined second lateral distance relative to the inboard mounting surface of the disc in a parallel relationship therewith, and operating the flow spinning machine to form both an inboard tire bead seat and an outboard tire bead seat of the wheel and to locate the inboard tire bead seat a predetermined first radial distance relative to the wheel axis and in a concentric relationship therewith and to locate the outboard tire bead seat a predetermined second radial distance relative to the wheel axis and in a concentric relationship therewith.

5. The method defined in claim 1 wherein the disc in step (b) is a full face disc and step (f) includes operating the flow spinning machine to flow spin the rim to form an inboard tire bead seat retaining flange and an inboard tire bead seat, and operating the flow spinning machine to flow spin the outer annular portion of the full face disc to form the outboard tire bead seat retaining flange to thereby produce a finished full face wheel.

6. The method defined in claim 1 wherein step (f) includes operating the flow spinning machine to flow spin the rim to form an inboard tire bead seat retaining flange, an inboard tire bead seat, an outboard tire bead seat, and an outboard tire bead seat retaining flange to thereby produce a finished wheel.

* * * * *